United States Patent [19]

Yamaji

[11] 4,104,093

[45] Aug. 1, 1978

[54] THERMIT COMPOSITION

[75] Inventor: Nobuyoshi Yamaji, Akashi, Japan

[73] Assignee: Foseco Trading A.G., Switzerland

[21] Appl. No.: 774,368

[22] Filed: Mar. 4, 1977

[30] Foreign Application Priority Data

Jun. 23, 1976 [JP] Japan ..... 51-74929

[51] Int. Cl.[2] ..... C06B 33/12

[52] U.S. Cl. ..... 149/40; 149/37

[58] Field of Search ..... 149/37, 40

[56] References Cited

U.S. PATENT DOCUMENTS 3,695,951 10/1972 Helms et al. ..... 149/37

*Primary Examiner*—Stephen J. Lechert, Jr.

*Attorney, Agent, or Firm*—Caesar, Rivise, Bernstein & Cohen, Ltd.

[57] ABSTRACT

A thermit composition useful for repairing ingot mould base plates is described. It comprises a particulate oxidizable metal, particulate iron oxide and a particulate refractory filler consisting wholly or partly of zircon, the refractory filler material being present in a proportion of 35 to 50 parts by weight per 100 parts by weight of easily oxidizable metal and iron oxide.

4 Claims, No Drawings

THERMIT COMPOSITION

FIELD OF THE INVENTION

This invention relates to thermit compositions and to their use in the repair of ingot mould bottom plates.

BACKGROUND OF THE INVENTION

Thermit compositions consisting of a mixture of finely divided oxidisable metal together with an oxidising agent therefor, usually consisting substantially or wholly of iron oxide. When such a composition is ignited, a highly exothermic reaction takes place with oxidation of the oxidisable metal and reduction of the iron oxide to molten iron. The oxidisable metal of choice is aluminium and a wide variety of thermit compositions is known which in addition to aluminium and iron oxides contains other modifying agents such as refractory fillers which slow down the speed of the reaction, and initiators such as fluorides which assist positive ignition of the whole of the mass of composition used.

In the casting of molten metals to form ingots, it is customary to pour molten metal into an ingot mould from a substantial height. The molten metal falling on the base of the mould, or on a separable bottom plate constituting the base of the mould, is very hot and the base or bottom plate is accordingly subjected to substantial erosive forces which wear a depression in the mould or bottom plate. Because the base of the mould wears much faster than the remainder, it is common practice to form the mould from a mould body superimposed on a substantially flat base plate which can then be scrapped when too eroded for further satisfactory use. Although separating mould body and base plate in this way leads to economies, even base plates themselves are expensive and accordingly it is desirable to prolong their life e.g. by repairing eroded areas. Mechanical methods such as welding steel plates and the like over eroded areas have been tried but these are difficult and time consuming to apply. Thermit compositions have also been proposed which may be applied to the eroded area and ignited there. They heat up and then cool to leave a solidified mass in the eroded area. Such known compositions have not proved very satisfactory in use. Many are difficult to apply, give off much fume when ignited, which is not only inconvenient but may constitute a health hazard and additionally do not lead to satisfactory reapirs.

OBJECT OF THE INVENTION

It is an object of the invention to provide thermit compositions of particular value in repairing eroded ingot mould base plates which minimise or avoid the disadvantages just noted.

BRIEF DESCRIPTION OF THE INVENTION

According to a first feature of the present invention there is provided a thermit composition comprising a particulate oxidisable metal, particulate iron oxide and a particulate refractory filler consisting wholly or partly of zircon, the particulate refractory filler being present in an amount of 35–50 parts by weight per 100 parts by weight of oxidisable metal and iron oxide.

The thermit compositions of the present invention may contain additional ingredients such as other oxidising agents and ignition aids, for example fluorides, if desired.

Preferably, the thermit compositions of the invention also contain, per 100 parts by weight of iron oxide and oxidisable metal, 0.1 to 5 parts by weight of a strong oxidising agent such as an alkali metal or ammonium nitrate and 1 to 8 parts by weight of a promoter, preferably a fluoride such as a cryolite, fluorspar or aluminium fluoride.

Preferably all of the refractory filler is zircon though if desired up to 50% by weight of the refractory filler may consist of other refractory filler. Other refractory fillers which may be admixed with the zircon filler include silica sand, silica flour, olivine, quartz, chamotte, mullite, crushed refractory fire brick, sillimanite, fire clay, silicon carbide, magnesite, aluminium silicate, dead burnt dolomite, alumina, magnesia, fused silica and vitreous silica.

The particle size of the refractory filler is of importance. Preferably all of the particles of the refractory filler are less than 2.0 mm and preferred materials are of sieve grading less than 0.5 mm to dust. Preferably the particle size distribution of the refractory filler material is one containing not too much dust since an excess of dust tends to stifle the exothermic reaction. Dusty refractory fillers may however be compensated for by formulating the thermit composition according to the present invention with a relatively increased proportion of easily oxidisable metal, usually aluminium, to iron oxide, and also by increasing the quantity of any strong oxidising agent preferably present. However, increasing both oxidisable metal content and strong oxidising agent content tends also to increase the tendency of the composition to generate fume when ignited and this is naturally undesirable in practice.

According to a further feature of the present invention there is provided a method of repairing an ingot mould base plate which comprises locating in an eroded cavity thereon a thermit composition according to the invention, igniting the composition and allowing it to melt and then to solidify in the cavity.

It is found that compositions according to the present invention give repairs to eroded ingot mould base plates of substantially greater durability than those achieved by prior art methods and using prior art compositions. In particular, the homogeneity of the material constituting the repair is substantially improved and the material left after the thermit composition has been fired is strongly bonded to the material of the ingot mould base plate.

When used, the thermit compositions according to the invention show a remarkable improvement in that the patch formed is substantially more homogeneous than that formed by prior art compositions which tend to have internal voids and substantial inhomogeneities in their structure. The presence of internal voids can lead to an interlocking during casting between the patch and the solidfying ingot, to such an extent that when at attempt is made to strip the ingot from the mould, the patch is pulled away from the base plate or at least substantially damaged during that process. In either case, the whole or part of the patch tends to adhere to the ingot and must be removed, e.g. by lancing, before the ingot can be rolled. Additionally, the base plate must then be repaired again if it is to be put back into service.

The following Examples will serve to illustrate the invention:

In order to evaluate the various examples of thermit compositions according to the invention set out below, a standardised test method was operated as follows:

Each of the compositions was made up simply by mixing the ingredients given in the proportions by weight given and a quantity of each composition was then placed in an eroded cone shaped cavity 40 to 50 cm in diameter 20 to 25 cm deep in a damaged base plate for a 20 ton ingot mould. The cavity was filled in each case to level with the upper surface of the base plate and after filling the thermit composition was ignited by applying to the surface a flame from an acetylene burner. After the composition had ignited it was simply allowed to burn and thereafter to cool and solidify. The amount of fume arising during burning was evaluated visually.

The base plates were then returned to service and the number of casts found before the plate had to be repaired again. The test was carried out on a plurality of base plates for each composition and the average number of casts determined.

EXAMPLES 1 to 4

The compositions tested and the results obtained are set out in tabular form in Table 1. Parts are by weight throughout. Details of the ingredients used are as follows:

Aluminium powder — particle size less than 0.15 mm
Zircon sand — particle size grading 2.0 mm to 0.1 mm
Zircon flour — particle size grading 1.0 mm to dust
Mullite — particle size 2.0 to dust The fluoride used was fluorspar and sodium nitrate was added in some cases as a strong oxidising agent.

TABLE 1

| EXAMPLE NO. | | 1 | 2 | 3 | 4 |
|---|---|---|---|---|---|
| Parts by Weight of | Aluminum | 26 | 28 | 29 | 30 |
| | Iron Oxide | 74 | 72 | 71 | 70 |
| | Zircon Sand | — | 20 | 42 | 23 |
| | Zircon Flour | 28 | 20 | — | 25 |
| | Mullite | 10 | — | — | — |
| | Fluoride | — | — | 3 | 3 |
| | Sodium nitrate | — | 4 | — | 5 |
| Fume on use | | mode-rate | high | low | high |
| Average repaired life (cycles) | | 18.2 | 21.6 | 19.4 | 16.7 |

EXAMPLE 5

The following specific formulation in which all parts are given by weight is particularly useful and is a preferred thermit composition according to the present invention:

| | |
|---|---|
| Aluminum powder | 27 parts |
| Iron oxide | 73 parts |
| Zircon sand* | 45 parts |
| Fluorspar | 6 parts |
| Sodium nitrate | 1 part |

*all less than 0.25 mm, 4% by weight less than .075 mm.

This composition burns out when used to repair ingot mould base plates with little or substantially no fume in 2 to 5 minutes.

I claim:

1. In a thermit composition comprising a particulate oxidizable metal, particulate iron oxide and particulate refractory filler, the improvement that the particulate refractory filler comprises zircon and is present in an amount of greater than 35 and up to 50 parts by weight per 100 parts by weight of the easily oxidizable metal and iron oxide.

2. The thermit composition of claim 1 wherein the particulate refractory filler is all of particle size less than 2.0 mm.

3. The thermit composition of claim 1 wherein more than 50% by weight of the refractory filler consists of zircon.

4. The thermit composition of claim 1 wherein the particulate refractory filler includes in addition to particulate zircon at least one further refractory filler selected from the class consisting of silica sand, silica flour, olivine, quartz, chamotte, mullite, crushed refractory fire brick, sillimanite, fire clay, silicon carbide, magnesite, aluminium silicate, dead burnt dolomite, alumina, magnesia, fused silica and vitreous silica.

* * * * *